United States Patent [19]

Yonezawa

[11] 4,348,883

[45] Sep. 14, 1982

[54] AUXILIARY DIE CONVEYOR FOR A PRESSING OR PUNCHING MACHINE

[76] Inventor: Keitaro Yonezawa, c/o Aioi Seiki K.K., 1-9 Aza Kaidoshita Kouniike, Itamishi, Hyogoken, Japan

[21] Appl. No.: 177,122

[22] Filed: Aug. 11, 1980

[30] Foreign Application Priority Data

Oct. 1, 1979 [JP] Japan ..... 54-136345[U]

[51] Int. Cl.[3] ..... B21J 13/00

[52] U.S. Cl. ..... 72/446; 100/918

[58] Field of Search ..... 72/446, 448, 419; 100/918, 229

[56] References Cited

U.S. PATENT DOCUMENTS

| | | | |
|---|---|---|---|
| 2,176,543 | 10/1939 | Norton | 100/918 |
| 2,908,405 | 10/1959 | Logan | 100/918 |
| 3,207,065 | 9/1965 | Danly | 100/918 |
| 3,213,739 | 10/1965 | Zingone | 100/918 |
| 4,152,978 | 5/1979 | Abe | 72/446 |

FOREIGN PATENT DOCUMENTS

| | | | |
|---|---|---|---|
| 55-50931 | 4/1980 | Japan | 72/446 |
| 623749 | 9/1978 | U.S.S.R. | 100/918 |
| 624797 | 9/1978 | U.S.S.R. | 100/918 |

*Primary Examiner*—Gene Crosby

*Attorney, Agent, or Firm*—Bacon & Thomas

[57] ABSTRACT

An auxiliary die conveyor includes a metal support jointed to a bolster and a die carrier including a pair of side plates, the carrier further including a hanging means in its upper tail section, the support metal including a depression adapted to interlock with the hanging means in such a manner as to allow the carrier to rotate in the depression while a lower part of the carrier comes into abutment with the support metal, thereby preventing the carrier from lowering below the level of the bolster.

7 Claims, 20 Drawing Figures

AUXILIARY DIE CONVEYOR FOR A PRESSING OR PUNCHING MACHINE

BACKGROUND OF THE INVENTION

1. Field of the Invention

The present invention relates to an auxiliary die conveyor adapted for attachment to a pressing or punching machine. More particularly, the present invention relates to an auxiliary die conveyor detachably connected to a pressing or punching machine so as to provide an extended conveying surface flush with the bolster of the machine when a die is mounted on or dismounted out of, the bolster, wherein when the machine is put into operation, the auxiliary die conveyor is detached so as to allow a working space around the machine.

2. Description of the Prior Art

The conventional auxiliary die conveyor is hinged to the bolster or bed of a pressing or punching machine, and when the machine is in regular operation, the conveyor is folded at the side of the machine so as to provide a working space. Nevertheless, the folded conveyor tends to become an obstacle for the operators. It often happens that the operators stumble and become injured by the horny projections provided by the folded conveyor.

The present invention is directed toward solving the inconvenience with respect to the known foldable auxiliary die conveyor, and has for its object to provide an improved auxiliary die conveyor detachably connected to the machine so as to remove the conveyor when the machine is put into operation.

Another object of the present invention is to provide an improved auxiliary die conveyor which makes it possible to employ a single conveyor from machine to machine, thereby eliminating the necessity of providing plural conveyors correspondingly to the number of machines. This saves the costs very much.

Other objects and advantages of the present invention will become more apparent from the following description when taken in connection with the accompanying drawings.

SUMMARY OF THE INVENTION

According to one advantageous aspect of the present invention, an auxiliary die conveyor includes a metal support jointed to a bolster and a die carrier including a pair of side plates, the carrier further including a hanging means in its upper tail section, the metal support including a depression adapted to interlock with the hanging means in such a manner as to allow the carrier to rotate in the depression while the lower part of the carrier comes into abutment with the metal support, thereby preventing the carrier from lowering below the level of the bolster.

According to another advantageous aspect of the invention an auxiliary die conveyor includes a first metal support and a second metal support wherein the first metal support is jointed to the end face of a bolster while the second metal support is jointed to the end face of the machine bed, and a die carrier including a pair of side plates and a support bar, wherein the side plates include a hanging means adapted to be received in a depression produced in the first metal support so as to allow the carrier as a whole to rotate in the depression and wherein the support bar is adapted to rest on the second metal support, thereby preventing the carrier from lowering below the level of the bolster.

DETAILED DESCRIPTION OF THE INVENTION

Figure 1:
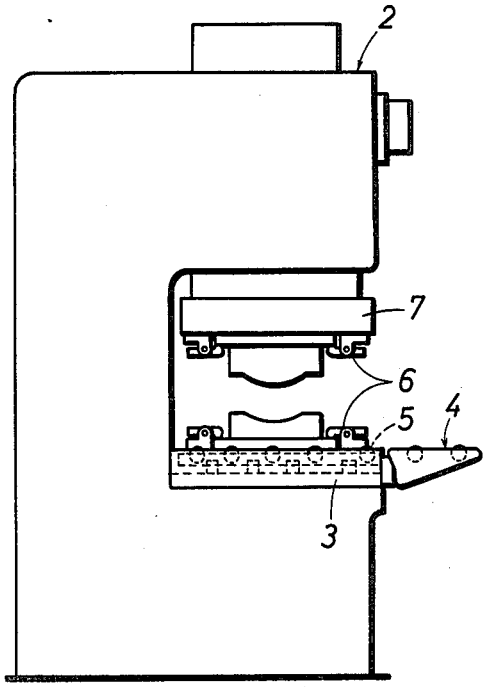
FIG. 1 is an overall side view of a pressing machine including an auxiliary die conveyor according to the present invention.

Referring to FIG. 1 reference numeral 2 designates a pressing machine and reference numeral 1 designates a pair of dies. An auxiliary die conveyor 4 is connected to a bolster 3 in the manner described below, so as to provide an extended conveying surface flush with the top surface of the bolster 3. The die 1 is initially mounted on the auxiliary die conveyor 4, and is transported onto the bolster. Then the dies 1 are respectively secured to the bolster 3 and a ram 7 by means of hydraulic clamps 6. The auxiliary die conveyor 4 hereinafter referred to merely as the conveyor, is constructed so as to be detachable to the bolster.

Figure 4:
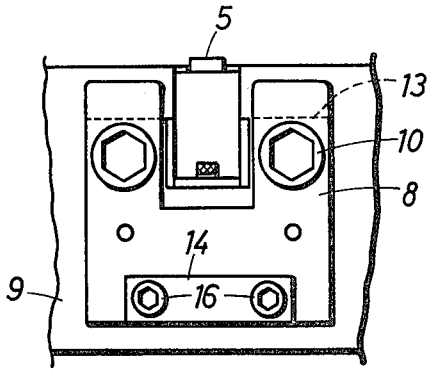
FIG. 4 is a front view of the metal support in FIG. 3.
Figure 2:
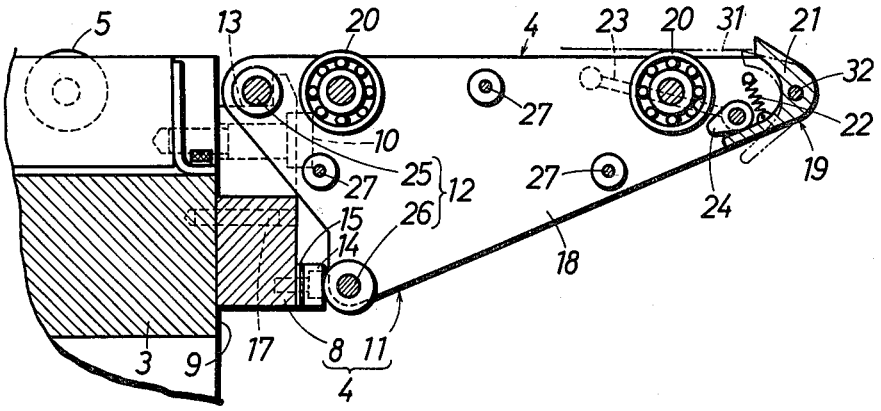
FIG. 2 is a vertical cross-section through the auxiliary die conveyor in FIG. 1.
Figure 3:
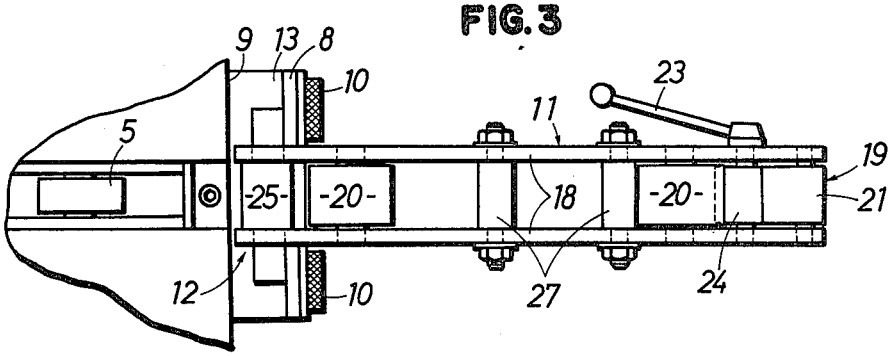
FIG. 3 is a plan view of the auxiliary die conveyor in FIG. 2.

Referring to FIGS. 2 to 4, the conveyor 4 includes a metal support 8 and a carrier 11, wherein the metal support is secured to the bolster 3. The carrier 11 includes a pair of side plates 18 with rollers 20 interposed therebetween. In addition, the carrier 11 includes rods 25 and 26 transversed through the side plates wherein the rod 25 is located in the upper tail section of the side plates while the rod 26 is located in the lower tail section thereof, adequately spaced from the rod 25. The metal support 8 is U-shaped as shown in FIG. 4, and has a depression or slot 13 in its top surface. In the illustrated embodiment two slots are provided. These slots 13 are adapted to receive the rod 25 when the carrier is hung on the metal support. In addition, the metal support 8 is provided with an abutment metal 14 on its lower front so as to allow the rod 26 of the carrier 11 to come into abutment therewith when the carrier is mounted on the metal support in the above-mentioned manner. The abutment metal 14 is jointed to the metal support 8 by means of bolts 16 with a cushion 15 interposed therebetween.

The carrier 11 is provided with a stop unit 19 for preventing the die on the conveyor 4 from slipping off. The stop unit 19 includes a pawl 21 biased by a spring 22 whereby the pawl is normally raised up above the peripheral surfaces of the rollers 20 as shown in FIG. 2. When the pawl 21 is to be lowered, a handle 23 is used to rotate the same on a pivot 32, thereby causing the pawl to sink below the die conveying level 31 as shown by imaginary lines in FIG. 2.

In this way the carrier is hung on the metal support 8 in which the carrier is rotatable with respect to the rigid metal support. However, the lower part of the carrier is placed into abutment with the metal support through the abutment metal, thereby ensuring that the carrier is held on the metal support with its top surface flush with the die conveying surface.

Figure 5:
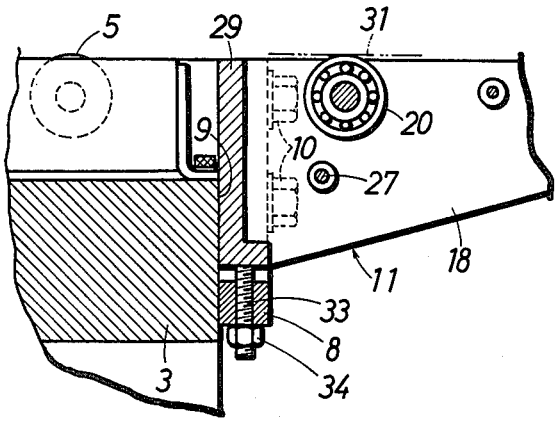
FIGS. 5 to 7 are a side, a front and a plan views of another modified version, respectively.
Figure 6:
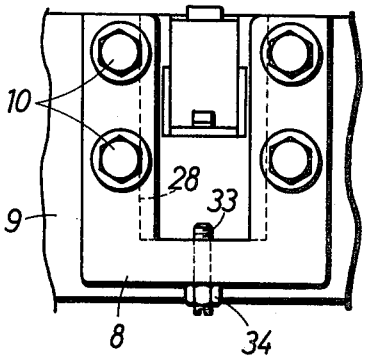
Figure 7:
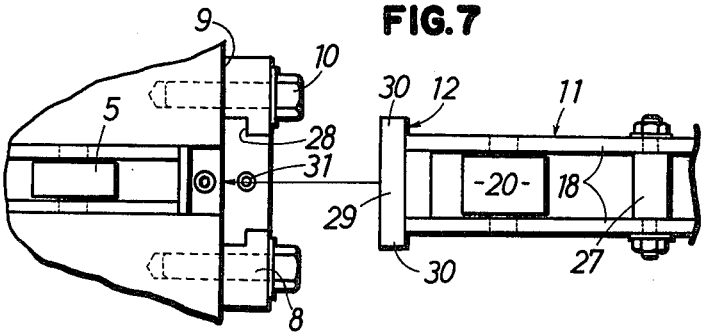
Figure 8:
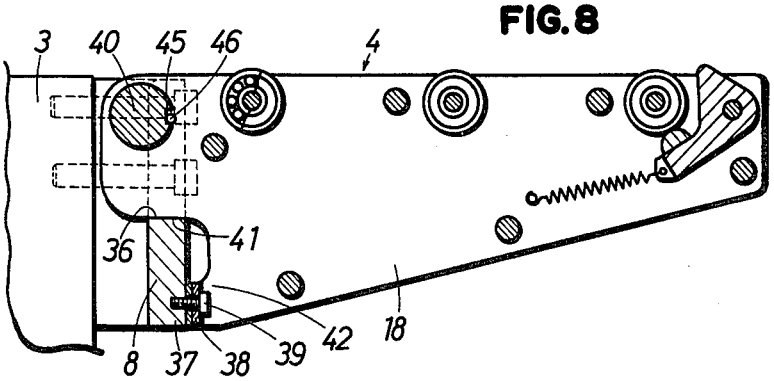
FIGS. 8 to 10 are a side, a plan and a front sectional views of a further modified version, respectively.
Figure 9:
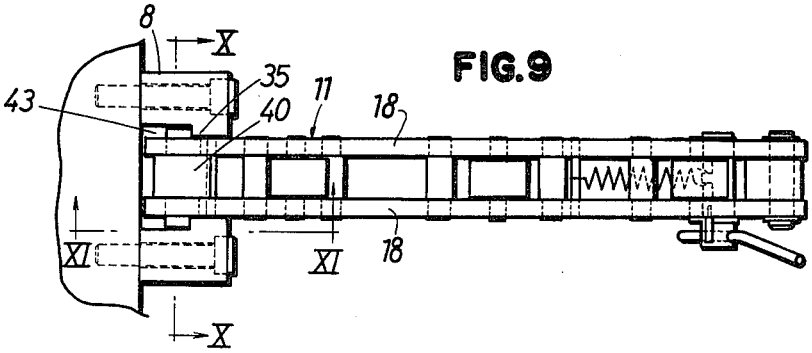
Figure 10:
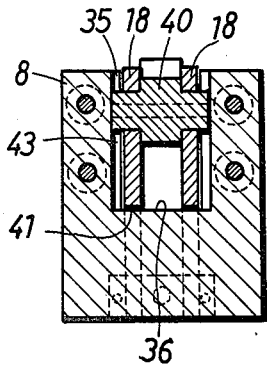

Referring to FIGS. 5 to 7, a modified version of the metal support and the carrier 11 will be now explained:

The U-shaped metal support 8 has slots 28 more deeply cut than the slot 13 in the first embodiment. The carrier 11 has an end plate 29 which has outwardly extended projections 30 adapted to fit in the slots 28 of the metal support 8. The metal support 8 includes an adjustable bolt 33 with a lock nut 34 for adjusting the height of the carrier 11 with respect to the surface of the bolster 3, as best shown in FIG. 5. The bolt 33 supports the end plate 29.

Figure 11:
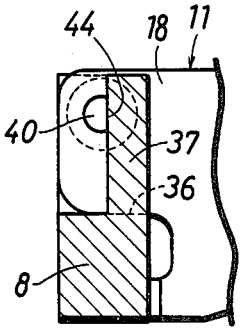
FIG. 11 is a vertical cross-section taken along the line Xl—Xl in FIG. 9.

Referring to FIGS. 8 to 11, a further modified version of the embodiment will be explained:

The metal support 8 is box-shaped with a front wall 37 and side walls 35, wherein the front wall is provided with a slot 36. The metal support 8 is jointed through a cushion 38 to the bolster 3 with the front wall 37 being faced to the carrier 11. Each side plate 18 of the carrier 11 is provided with a main flange portion 41 and a subordinate flange portion 42. The main flange portions 41 are provided with outwardly extended rotating pins 40. The carrier 11 is supported on the metal support 8, wherein the main flange portions 41 are received in the slot 36 with the subordinate flange portions 42 being placed in abutment with the front wall 37 of the metal support. At this stage the pins 40 are engaged to behind the front wall 37, thereby securing the carrier 11 to the metal support 8. The pin 40 has a flat portion 44 which allows the pin 40 to keep plane-to-plane contact with the back of the front wall 37, as shown in FIG. 11. The pin 40 can be provided with a cutaway portion 45 in which a pin 46 erected on the side plate 18 is engaged, whereby the rotation of the pin 40 is limited to a certain angular range. The rotatable pins 40 allow the carrier to be smoothly mounted on or dismounted from, the metal support 8.

Figure 12:
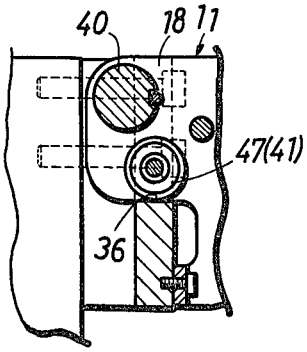
FIG. 12 is a vertical cross-section through modified portions of the die carrier and the metal support.
Figure 13:
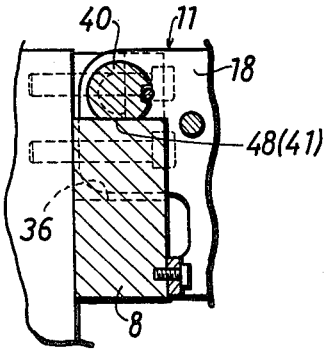
FIGS. 13 and 14 are a vertical cross-section and a plan views of another modified version of the portions in FIG. 12.
Figure 14:
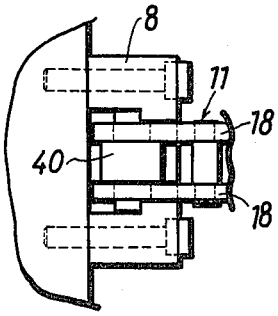
Figure 15:
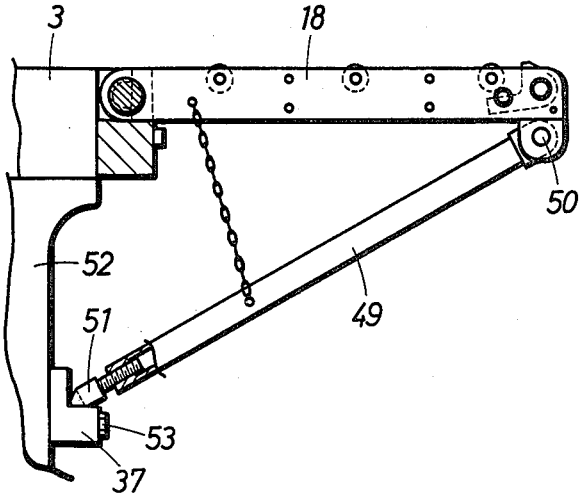
FIG. 15 is a side view of a further modified version of the auxiliary die conveyor.
Figure 16:
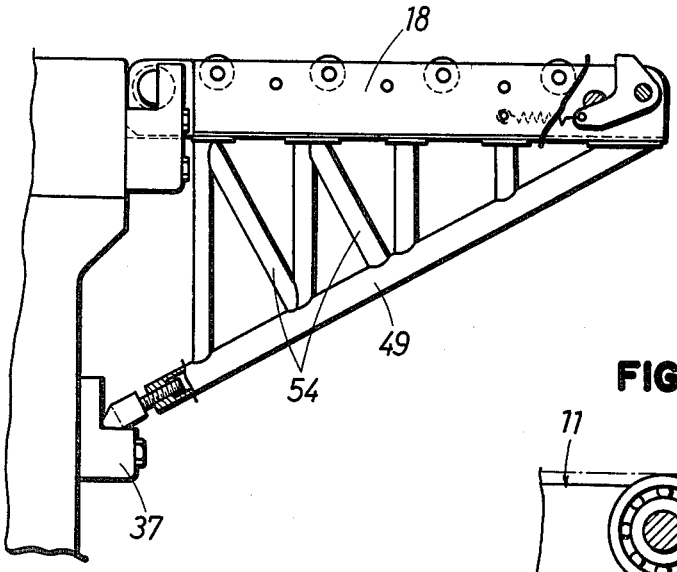
FIG. 16 is a side view of a modified version of the embodiment in FIG. 15.

As shown in FIG. 12, the main flange portion 41 of each side plate 18 can be provided with a roller 47 so as to enable the carrier 11 to smoothly fit in the slot 36. Alternatively, as shown in FIGS. 13 and 14, the portion of the pin 40 between the side plates 18 can be made thick and provided with a flat cutaway portion at which the carrier 11 rests on the bottom of the slot 36. As a third alternative, as shown in FIG. 15 the side plates 18 can be bars with a support 49 pivotally connected at 50 thereto. The opposite end of the bar 18 includes an adjustable screw 51 adapted to engage with a receiver 37, which is jointed to the side of the bed 52 of the machine by means of a bolt 53. This type of the carrier can be further modified as shown in FIG. 16. In the illustrated embodiment the side bars 18 and the support 49 are rigidly connected by means of rods 54.

Figure 17:
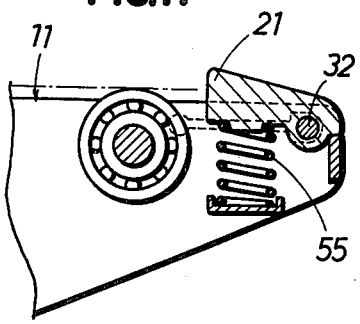
FIGS. 17 and 18 are a vertical cross-section and a plan view of a stop means.
Figure 18:
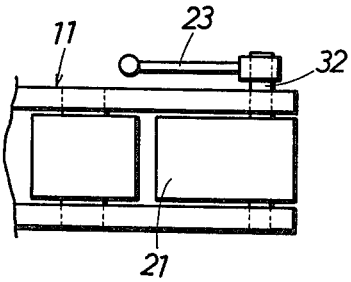

Referring now to FIGS. 17 to 20, various modifications of the stop unit 19 will be explained:

In the embodiment illustrated in FIGS. 17 and 18 the pawl 21 is supported on a coil spring 55 wherein the pawl is normally raised up sufficiently to stop the die from falling off the carrier 11. The pawl 21 is lowered through a pivot 32 by means of the handle 23 so as to keep the die free from the pawl.

Figure 19:
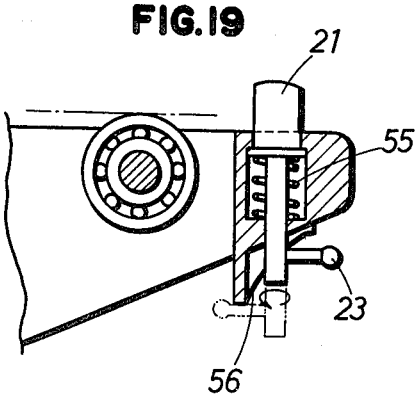
FIGS. 19 and 20 are vertical cross-sections through further modified versions of the stop means.
Figure 20:
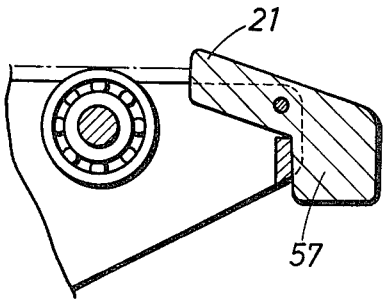

In the embodiment illustrated in FIG. 19 the pawl 21 is vertically supported a coil spring 55 so as to allow the pawl to vertically rise and lower. A cam device 56 is provided so as to guide the handle 23 whereby the vertical pawl 21 is lowered. FIG. 20 shows a further modified embodiment in which the pawl 21 has a weight 57 at its tail portion whereby the same is raised above the level of the bolster.

According to the present invention the die carrier is readily jointed to the metal support, that is, the bolster, and when the machine is put into operation, it can be easily detached therefrom. Accordingly, the working space accrues around the machine, otherwise the auxiliary die conveyor is likely to be an obstacle for the operators. Another advantage is that a single conveyor can be applied to plural machines, and the provision of a single unit is sufficient to cover several machines. This saves the costs of die conveyors. A further advantage is that the die conveyor has no hinged portion, which makes it possible that the die conveyor is robust as well as simplified in construction.

What is claimed is:

1. An auxiliary die conveyor for attachment to a punching or pressing machine, said conveyor comprising:

a metal support adapted to be jointed to the bolster of said machine;

a die carrier including a pair of side plates and rollers for allowing a die to roll thereon;

said die carrier having an upper tail section and a lower section and including a hanging means in its upper tail section;

said metal support including a depression in its upper section, said depression being adapted to interlock with said hanging means;

said metal support including an abutment means in its lower section, said abutment means being adapted to allow said carrier to rest thereon.

2. An auxiliary die conveyor as defined in claim 1, wherein the depression in said metal support is a slot vertically cut from the top surface thereof.

3. An auxiliary die conveyor as defined in claim 1, wherein the hanging means is a rod transversed through said side plates, said rod having both ends projecting outwardly of said side plates so as to interlock with said depression.

4. An auxiliary die conveyor as defined in claim 1, wherein the hanging means is an end plate including projections extended outwardly of said side plates, said projections being adapted to interlock with said depression.

5. An auxiliary die conveyor as defined in claim 1, wherein the metal support is box-shaped with a front wall and two opposite side walls, said front wall including a vertically cut slot adapted to receive said carrier therein with said hanging means positioning within the interior of said support metal.

6. An auxiliary die conveyor as defined in claim 5, wherein the hanging means includes a flat face adapted to keep face-to-face contact with the back of said front wall, and wherein the hanging means includes a means for limiting the rotation thereof in a certain angular range.

7. An auxiliary die conveyor for attachment to a punching or pressing machine, said conveyor comprising:

a metal support adapted to be jointed to the bolster of said machine;

a die carrier including a pair of side plates and rollers for allowing a die to roll thereon;

said die carrier having an upper section and a lower section and including a hanging means in its upper tail section;

said metal support including a depression in its upper section, said depression being adapted to interlock with said hanging means;

said metal support including an abutment means in its lower section, said abutment means being adapted to allow said carrier to rest thereon, the die carrier further including a stop means for preventing a die from slipping off, said stop means including a pawl supported on a spring means in such a manner as to enable said pawl to normally rise above the conveying level of said die; and, a handle connected to said spring so as to control the rise and fall of said pawl with respect to the conveying level of a die.

* * * * *